United States Patent [19]

Konars et al.

[11] 4,082,262

[45] Apr. 4, 1978

[54] FEEDER HOPPER FOR DOCUMENTS

[75] Inventors: Clement R. Konars, Glen Cove; Emanuel Quinci, Dix Hills, both of N.Y.

[73] Assignee: Halm Instrument Co., Inc., Glen Head, N.Y.

[21] Appl. No.: 768,147

[22] Filed: Feb. 14, 1977

[51] Int. Cl.[2] ..... B65H 1/02

[52] U.S. Cl. ..... 271/149; 271/157

[58] Field of Search ..... 271/149, 157, 158, 159, 271/30 A, 129

[56] References Cited

U.S. PATENT DOCUMENTS

| | | | |
|---|---|---|---|
| 3,249,353 | 5/1966 | Parker | 271/129 X |
| 3,915,338 | 10/1975 | Kronseder | 271/149 X |

FOREIGN PATENT DOCUMENTS

| | | | |
|---|---|---|---|
| 369,550 | 2/1923 | Germany | 271/158 |

*Primary Examiner*—Richard A. Schacher
*Attorney, Agent, or Firm*—James P. Malone

[57] ABSTRACT

A feeder hopper for documents. A pair of guide rods are slidably mounted in a base member. A rear plate is mounted on the guide rods. A second plate pivotally and slidably mounted on one side of the guide rods. The plates are adapted to nest together. Means are provided to push back the rear plate back from the second plate when it is desired to add a new supply of documents to the hopper. The second plate holds the stack in position. After the new sheets are added the second plate is rotated out of the stack.

3 Claims, 5 Drawing Figures

FEEDER HOPPER FOR DOCUMENTS

This invention relates to a feeder hopper for documents and more particularly to such means having new and improved means for adding an additional supply of documents.

In feeding hoppers for documents or sheets which feed the document by means of gravity, it is difficult to add new sheets without disturbing the existing stack already in the hopper. When adding new documents to the hopper it is necessary for the operator to move back the rear plate of the hopper with one hand and try to insert the new documents in the stack. This is difficult or impossible if the documents are heavy and/or slippery because the existing portion of the stack generally slides down out of alignment and it is practically impossible to handle a stack of sheets with one hand, especially if they are slippery as in the case of multiple carbon forms.

The present invention solves this difficulty by providing a hopper feeder having a pair of rear plates which nest together. One of the plates has curved fingers and the other has corresponding apertures to receive the curved fingers. One of the plates is pivotally and slidably mounted and the other plate is slidably mounted only.

When it is desired to insert a new supply of documents in the stack a foot control is pressed which actuates a pneumatic cylinder to push back the slidable rear plate. However, the pivotally mounted rear plate remains in place holding the existing stack in good order. Therefore, the new stack may be inserted with both hands. The pivotally mounted plate is then pivoted out of the way.

Accordingly, a principal object of the invention is to provide new and improved hopper means for documents.

Another object of the invention is to provide a new and improved hopper for documents having means to push back the rear plate of the hopper and means to maintain the existing stack in perfect alignment.

Another object of the invention is to provide new and improved hopper feeder for documents comprising a base member, a pair of guide rods slidably mounted in the base member, a rear plate mounted on the guide rods, a second plate pivotally and slidably mounted on one side of the guide rods, and means to push back the rear plate back from the second plate when it is desired to add a new supply of documents to the hopper.

These and other objects of the invention will be apparent from the following Specification and drawings of which:

Figure 1:
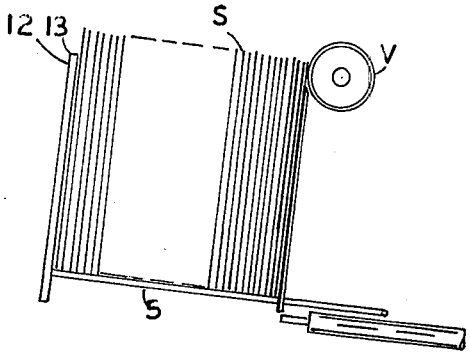
FIGS. 1 and 1A and 1B are diagrams illustrating the operation of this invention.

In FIG. 1, the stack of sheets S is mounted on the sliding rods 5 and held in place by rear plates 12 and 13, which nest together. The sheets are fed to the vacuum pick-off device V.

Figure 1A:
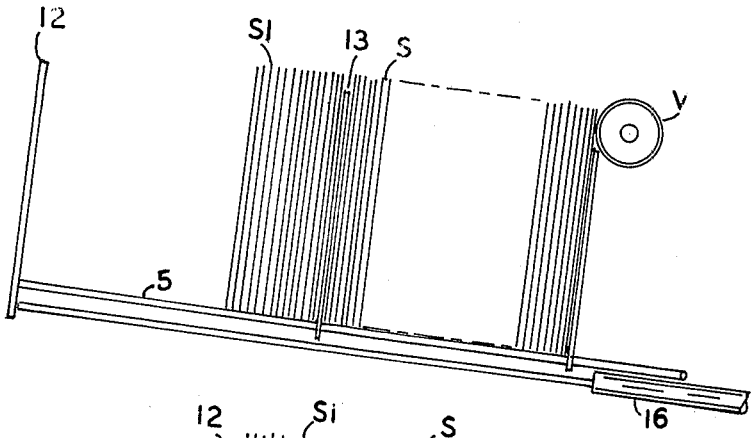

In FIG. 1A, it is desired to replenish the stack of sheets. The pneumatic cylinder 16 is actuated pushing back the plate 12 so that the additional sheets S1 can be inserted with both hands. During the adding of the new sheets the plate 13 holds the original sheets S in good alignment.

Figure 1B:
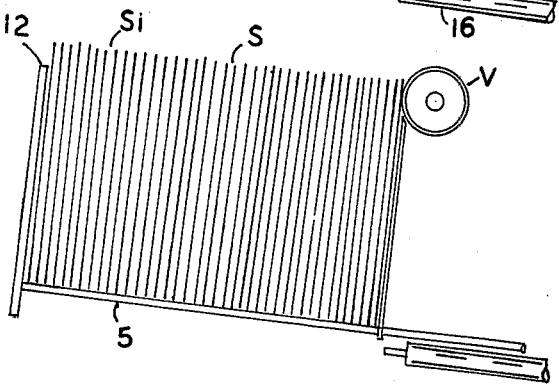

In FIG. 1B the rear plate 12 has been pushed back to allow space for the sheets S, and the rotatably mounted plate 13 has been rotated in to hold the stack in place before the pneumatic cylinder 16 has been actuated to move plate 12 back. The stack can then be replenished while the sheets are being fed to the vacuum pick-off device at normal speed without any interruption.

Figure 2:
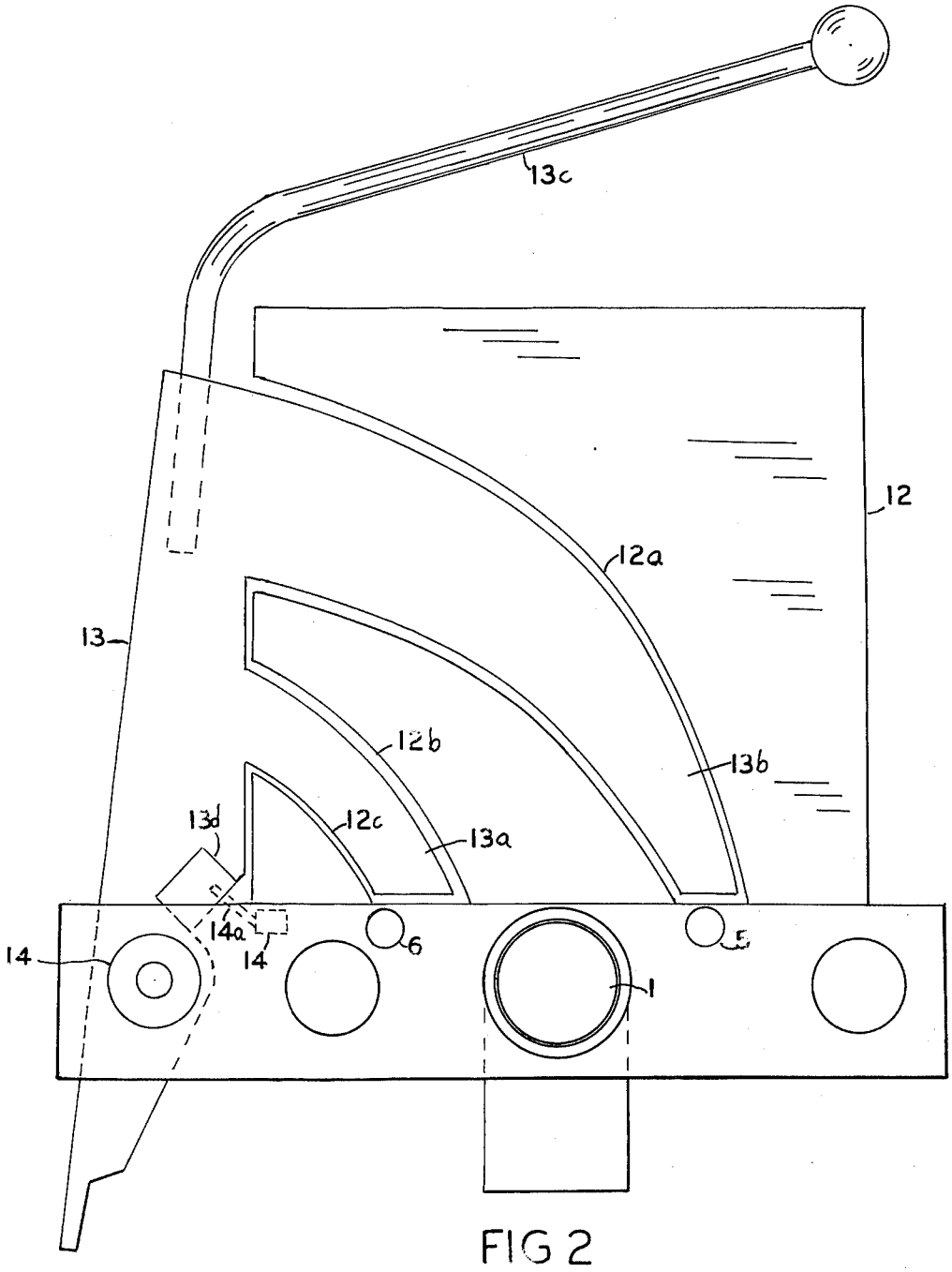
FIG. 2 is an end view of an embodiment of the invention.
Figure 3:
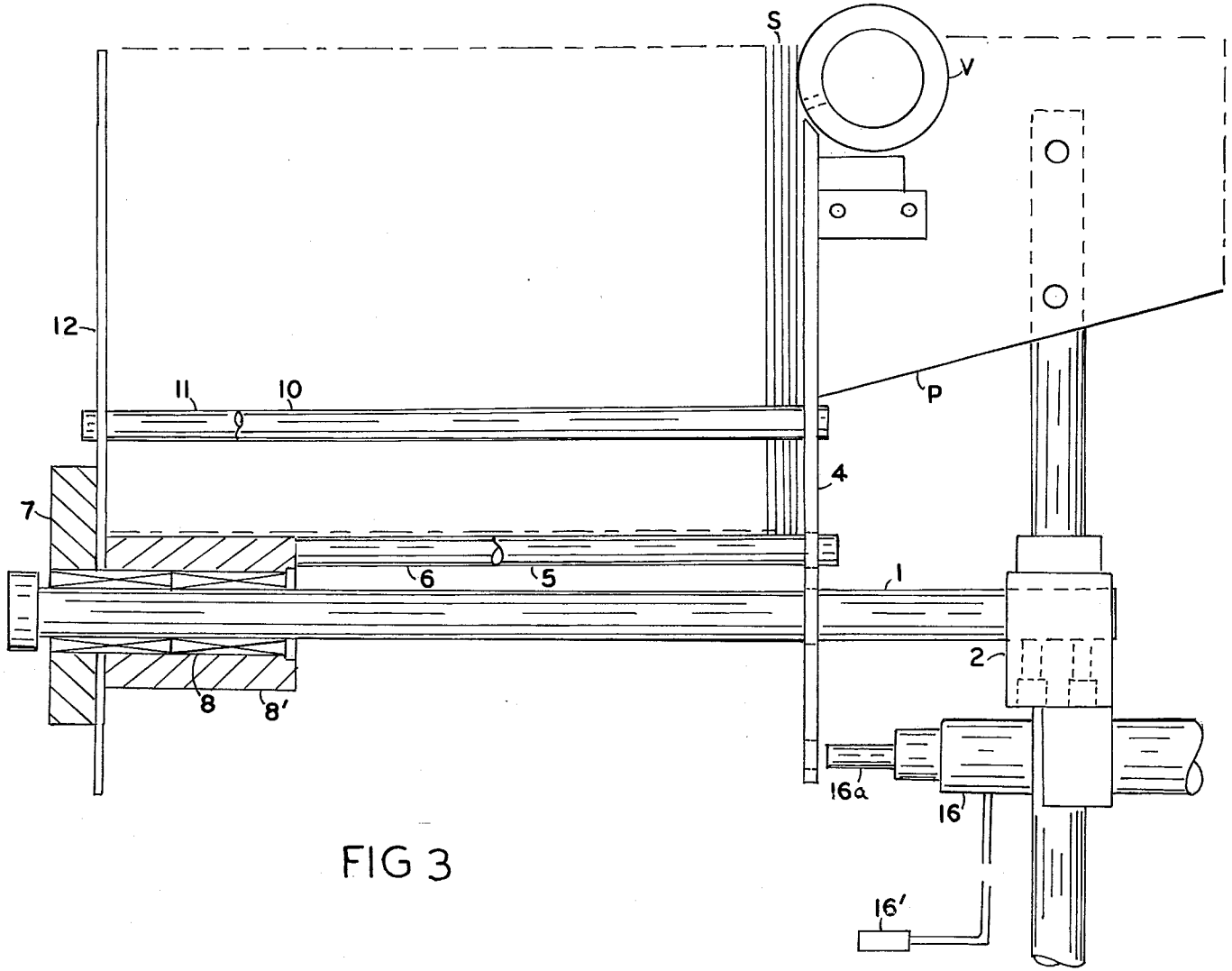
FIG. 3 is a side view of the embodiment of FIG. 1.

Referring to FIGS. 2 and 3, the hopper is designed to feed the sheets S to a vacuum feeder V which is mounted on an existing apparatus P, for instance, a printing press. The present invention generally comprises a base member 1, which may be clamped on to the existing printing press by means of the clamp block 2. The base 1, is mounted at an angle to the horizontal so that gravity will assist the feeding. Vertical plate 4 is mounted on the base and serves to position the first sheet in contact with the vacuum feeder V. A pair of slidable rods 5 and 6 are mounted on the plate 7 which is mounted on the base rod 1 by means of low friction bearings 8. The bearing block 8' has appreciable weight so that gravity will cause it to move in the feeding direction. The sheets S are mounted on the slidable rods 5 and 6 between stationary side guide rods 10 and 11. The plate 12 is fixedly mounted on the slidable rods 5 and 6. This plate has finger like apertures 12*a*, 12*b* and 12*c*.

A second plate 13 is pivotally and slidably mounted on the rod 14. The plate 13 has fingers 13*a* and 13*b* which nest into the corresponding finger like apertures of the plate 12, as shown in FIG. 1. The plate 13 has a handle 13*c* to facilitate rotating the plate 13. A rack 14 having equally spaced teeth 14*a* is mounted on the base member. The plate 13 has a projection member 13*d* which is adapted to be locked into the teeth of the rack at various positions.

A pneumatic cylinder 16 is mounted on the printing press and is adapted to be operated by a foot pedal 16'. When the pneumatic cylinder is actuated its rod 16*a* moves to the left in FIG. 2 and move the plate 12 back.

The operation of the device is as follows.

Assuming the hopper is one half filled with sheets S with the rear plate 12 pressing against the rear sheets. It is now desired to add more sheets to the stack, the plate 13 is moved into contact with the rear sheet with its fingers nesting in the apertures of plate 12, the plate 13 is then rotated slightly clockwise with the handle 13*c* so as to lock it in position in the rack 14. The foot pedal of the pneumatic cylinder is now pressed and the rod 16*a* of the pneumatic cylinder pushes back the plate 12. The plate 13 remains in position holding the existing stack in perfect order. The additional sheets are then added to the stack behind the fingered plate 13. The rear plate 12 is then advanced with the assistance of gravity into contact with the rear sheet of the newly installed stack. The handle 13' is then rotated counterclockwise in FIG. 2, causing the fingers 13*a* and 13*b* to rotate out of the stack.

This replenishing operation can be accomplished while the printing press is proceeding at normal speed with the vacuum sucker V removing sheets continuously. This is possible because the fingered plate 13 maintains pressure on the stack while the additional sheets are being placed in the stack. Therefore, there is no interruption of service.

We claim:

1. A feeder hopper for documents comprising, a base member, a pair of guide rods slidably mounted in the base member, a rear plate mounted on the guide rods, a second plate pivotally and slidably mounted on one side of the guide rods, and means to push back the rear plate back from the second plate when it is desired to add a new supply of documents to the hopper.

2. Apparatus as in claim 1 wherein the pushing means comprises a pneumatic cylinder.

3. Apparatus as in claim 1, wherein the pivotally mounted plate has the form of curved fingers and the rear plate has finger like apertures adapted to receive said fingers.

* * * * *